US009276345B2

(12) United States Patent
Guillanton et al.

(10) Patent No.: US 9,276,345 B2
(45) Date of Patent: Mar. 1, 2016

(54) ELECTRICAL CONNECTOR

(71) Applicant: DELPHI INTERNATIONAL OPERATIONS LUXEMBOURG, S.A.R.L., Bascharage (LU)

(72) Inventors: Melanie Guillanton, Maintenon (FR); Olivier Goletto, Bois d'Arcy (FR)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 0 days.

(21) Appl. No.: 14/385,505

(22) PCT Filed: Mar. 14, 2013

(86) PCT No.: PCT/EP2013/055305
§ 371 (c)(1),
(2) Date: Sep. 16, 2014

(87) PCT Pub. No.: WO2013/135849
PCT Pub. Date: Sep. 19, 2013

(65) Prior Publication Data

US 2015/0056829 A1 Feb. 26, 2015

(30) Foreign Application Priority Data

Mar. 16, 2012 (WO) ..... PCT/IB2012/000642

(51) Int. Cl.

| | |
|---|---|
| ***H01R 13/44*** | (2006.01) |
| ***H01R 13/422*** | (2006.01) |
| ***H01R 13/518*** | (2006.01) |
| ***H01R 13/641*** | (2006.01) |
| ***H01R 24/76*** | (2011.01) |
| *H01R 13/436* | (2006.01) |
| *H01R 13/629* | (2006.01) |

(52) U.S. Cl.
CPC ..... *H01R 13/44* (2013.01); *H01R 13/4226* (2013.01); *H01R 13/518* (2013.01); *H01R 13/641* (2013.01); *H01R 24/76* (2013.01); *H01R 13/4365* (2013.01); *H01R 13/62944* (2013.01)

(58) Field of Classification Search
CPC ..... H01R 13/4361; H01R 13/4223
USPC ..... 439/595, 752
See application file for complete search history.

(56) References Cited

U.S. PATENT DOCUMENTS 4,973,268 A * 11/1990 Smith ..... H01R 13/443 439/589
5,443,403 A 8/1995 Weidler et al.
(Continued)

FOREIGN PATENT DOCUMENTS

DE 102007037176 B3 2/2009
EP 220394 A2 5/1987

OTHER PUBLICATIONS

Search Report for International Publication No. WO 2013/135849 A1, Sep. 19, 2013.

*Primary Examiner* — Ross Gushi
(74) *Attorney, Agent, or Firm* — Robert J. Myers

(57) ABSTRACT

An electrical connector comprising one or more housings and a carrier adapted to receive the housing(s). The housing comprises a flexible lance adapted to flex to maintain an electrical contact in the receptacle. The carrier comprises a protrusion. When the lance is in its unlock condition, the lance cooperates with the protrusion to prevent the housing from reaching the assembled position with respect to the carrier. When the lance is in its lock condition, the lance does not cooperate with the protrusion.

14 Claims, 10 Drawing Sheets

(56) References Cited

U.S. PATENT DOCUMENTS 5,573,432 A * 11/1996 Hatagishi ..... H01R 13/506 439/459
5,716,233 A 2/1998 Muzslay
5,944,558 A * 8/1999 Iwahori ..... H01R 13/4365 439/595
5,967,859 A * 10/1999 Cecil, Jr. ..... H01R 13/4368 439/595
5,989,066 A * 11/1999 Cox ..... H01R 13/4365 439/595
5,997,359 A * 12/1999 Picaud ..... H01R 13/516 439/686
6,030,256 A * 2/2000 Cappe ..... H01R 13/506 439/598
6,045,404 A * 4/2000 Myer ..... H01R 13/4223 439/595
6,068,512 A * 5/2000 Sugie ..... H01R 13/4368 439/595
6,149,462 A * 11/2000 Sugie ..... H01R 13/4368 439/595
6,149,473 A * 11/2000 Lalange ..... H01R 13/4368 439/157
6,152,768 A * 11/2000 Beugnot ..... H01R 13/4365 439/595
6,186,813 B1 * 2/2001 Tomita ..... H01R 13/4364 439/271
6,247,966 B1 * 6/2001 Klein ..... H01R 13/4223 439/595
6,261,133 B1 * 7/2001 Kubo ..... H01R 13/4362 439/595
6,328,614 B1 * 12/2001 Osawa ..... H01R 13/4223 439/752
6,354,867 B1 * 3/2002 Tachi ..... H01R 13/40 439/488
6,358,101 B1 * 3/2002 Noro ..... H01R 13/4362 439/145
6,375,504 B1 * 4/2002 Ito ..... H01R 13/516 439/596
6,461,177 B1 * 10/2002 Saka ..... H01R 13/4362 439/157
6,478,620 B1 * 11/2002 Bonavita ..... H01R 12/7005 439/589
6,482,047 B1 * 11/2002 Lytle, Jr. ..... H01R 13/4361 439/752
6,527,583 B2 * 3/2003 Plate ..... H01R 13/4362 439/157
6,533,611 B2 * 3/2003 Morello ..... H01R 13/4361 439/595
6,547,605 B2 * 4/2003 Daugherty ..... H01R 13/5025 439/686
6,582,242 B2 * 6/2003 Murakami ..... H01R 13/5219 439/271
6,599,150 B1 * 7/2003 Martin ..... H01R 13/4364 439/595
6,638,108 B2 * 10/2003 Tachi ..... H01R 13/4223 439/540.1
6,638,109 B2 * 10/2003 Kurimoto ..... H01R 13/4362 439/595
6,666,718 B2 * 12/2003 Endo ..... H01R 13/4362 439/595
6,666,730 B2 * 12/2003 Canuto ..... H01R 13/4361 439/598
6,692,288 B2 * 2/2004 Nimura ..... H01R 13/641 439/352
6,832,937 B1 * 12/2004 Wrede ..... H01R 13/4361 439/358
6,913,494 B2 * 7/2005 Ward ..... H01R 13/4365 439/352
6,948,978 B2 * 9/2005 Itou ..... H01R 13/4364 439/595
6,971,924 B2 * 12/2005 Fujita ..... H01R 13/516 439/701
7,014,511 B2 * 3/2006 Sagawa ..... H01R 13/4365 439/752
7,044,808 B1 * 5/2006 Foltz ..... H01R 13/4362 439/752
7,112,104 B2 * 9/2006 Sagawa ..... H01R 13/4365 439/595
7,114,992 B2 * 10/2006 Sagawa ..... H01R 13/4365 439/595
7,114,997 B2 * 10/2006 Sagawa ..... H01R 13/4365 439/595
7,207,841 B2 * 4/2007 Machida ..... H01R 13/4223 439/595
7,223,130 B2 * 5/2007 Osada ..... H01R 13/4362 439/157
7,252,556 B2 * 8/2007 Anbo ..... H01R 13/4367 439/357
7,275,946 B2 * 10/2007 Ohtaka ..... H01R 13/7032 200/51.1
7,347,744 B2 * 3/2008 Tabata ..... H01R 13/514 439/289
7,390,228 B2 * 6/2008 Rimke ..... H01R 13/4223 439/595
7,435,113 B2 * 10/2008 Cheng ..... H01R 13/6295 439/157
7,654,865 B2 * 2/2010 Chazottes ..... H01R 13/4223 439/595
7,670,177 B2 * 3/2010 Myer ..... H01R 13/4365 439/595
7,698,810 B2 * 4/2010 Huss, Jr. ..... H01R 13/432 29/758
7,780,484 B2 * 8/2010 Martin ..... H01R 13/4223 439/752
7,785,146 B2 * 8/2010 Chazottes ..... H01R 13/4365 439/595
7,867,028 B2 * 1/2011 Brown ..... H01R 13/4223 439/595
8,226,436 B2 * 7/2012 Suzuki ..... H01R 13/113 439/595
8,262,410 B2 * 9/2012 Campbell ..... H01R 13/4365 439/595
8,419,471 B2 * 4/2013 Suzuki ..... H01R 13/4223 439/595
8,641,458 B2 * 2/2014 Matsumura ..... H01R 13/4364 439/595
8,678,865 B2 * 3/2014 Hiraishi ..... H01R 13/4365 439/595
8,678,866 B2 * 3/2014 Hiraishi ..... H01R 13/4365 439/595
8,708,739 B2 * 4/2014 Takeda ..... H01R 13/4223 439/595
8,784,133 B2 * 7/2014 Suzuki ..... H01R 13/4223 439/595
8,968,038 B2 * 3/2015 Kida ..... H01R 12/7023 439/374
2001/0003689 A1 * 6/2001 Kim ..... H01R 13/4226 439/752
2001/0023154 A1 * 9/2001 Kashiyama ..... H01R 13/641 439/752
2001/0027058 A1 * 10/2001 Pederson ..... H01R 13/641 439/595
2001/0055907 A1 * 12/2001 Murakami ..... H01R 13/4365 439/595
2002/0009923 A1 * 1/2002 Kashiyama ..... H01R 13/641 439/595
2004/0242084 A1 * 12/2004 Fujita ..... H01R 13/4223 439/752
2005/0186842 A1 * 8/2005 Fukatsu ..... H01R 13/4223 439/595
2006/0003631 A1 * 1/2006 Fukatsu ..... H01R 13/5221 439/595
2006/0141862 A1 * 6/2006 Machida ..... H01R 13/4223 439/595
2006/0270256 A1 * 11/2006 Huss ..... H01R 13/432 439/157
2006/0281373 A1 * 12/2006 Anbo ..... H01R 13/4367 439/752
2009/0088022 A1 * 4/2009 Krivohlavek ..... H01R 13/4362 439/595
2013/0059481 A1 * 3/2013 Neumeuer ..... H01R 13/432 439/676
2015/0056829 A1 * 2/2015 Guillanton ..... H01R 13/4226 439/131

* cited by examiner

ELECTRICAL CONNECTOR

CROSS-REFERENCE TO RELATED APPLICATION

This application is a national stage application under 35 U.S.C. §371 of PCT Application Number PCT/EP2013/055305 having an international filing date of Mar. 14, 2013, which designated the United States, said PCT application claiming the benefit of PCT Application Number PCT/IB2012/000642, having an international filing date of Mar. 16, 2012, which also designated the United States, the entire disclosure of each of which are hereby incorporated herein by reference.

TECHNICAL FIELD OF THE INVENTION

The present invention relates to electrical connectors.

BACKGROUND OF THE INVENTION

In particular, the present invention is related to an electrical connector having an outside or encompassing enclosure with an interior space which receives a module which can be inserted, and which can receive electrical contacts.

Such a module comprises at least one housing with a plurality of receptacles each adapted to receive a respective electrical contact.

Published European application EP0220394 already describes such an electrical connector with an inner housing and a surrounding housing, the square inner housing having chambers for contact elements and also at least one longitudinal separating wall. The surrounding housing is surrounding the inner housing in a positively locking manner, and a cable channel is arranged above the inner housing in the surrounding housing. The locking of the contact in the inner housing is provided by a flexible lance of the contact on one side of the receptacle, which cooperates with a shoulder of a receptacle. An additional blocking device for the contact elements is provided, which can be pushed into the inner housing and projects into the chambers. The additional blocking device is designed as one piece with respect the surrounding housing. The blocking function is provided on the side of the receptacle opposite to the locking side. However, when bigger contacts come into play, the above locking system has proved inefficient.

BRIEF SUMMARY OF THE INVENTION

In accordance with one embodiment of the invention, an electrical connector is provided. The electrical connector includes at least one housing with receptacles each adapted to receive a respective electrical contact, and a carrier adapted to receive at least one housing, which is movable with respect to the carrier between a pre-assembly position and an assembled position. The housing comprises a base and at least one receptacle, a flexible lance adapted to flex between a lock condition wherein it is adapted to maintain an electrical contact in the receptacle, and an unlock condition wherein it does not maintain the electrical contact in the receptacle. The carrier comprises a protrusion, wherein upon moving the housing with respect to the carrier from the pre-assembly position toward the assembled position, the lance cooperates with the protrusion to prevent the housing from reaching the assembled position with respect to the carrier, when the lance is in its unlock condition. When the lance is in its lock condition, upon moving the housing with respect to the carrier from the pre-assembly position toward the assembled position, the lance does not cooperate with the protrusion and does not prevent the housing from reaching the assembled position with respect to the carrier.

With these features, it is provided a simple and reliable locking of the contacts without losing any of the requested other functions.

In other embodiments, one might also use one or more of the following features taken alone or in combination:

At least one housing defining at least one row of receptacles each adapted to receive at least one respective electrical contact, wherein the housing comprises a base and a flexible lance, this feature enables the electrical connector to connect plurality of electrical wires with various correspondent electrical contacts into the carrier;

The housing comprises a base and at least one receptacle. A flexible lance is adapted to flex with respect to the base between a lock condition wherein it maintains an electrical contact in the receptacle, and an unlock condition wherein it does not maintain the electrical contact in the receptacle, thereby enabling to lock the various correspondent electrical contacts in the assembled position.

In accordance with another embodiment of the invention, an electrical connector is provided. The electrical connector includes a carrier and at least one housing as defined above. The housing comprises a base and at least one receptacle, a flexible lance adapted to flex between a lock condition wherein it is adapted to maintain an electrical contact in the receptacle, and an unlock condition wherein it does not maintain the electrical contact in the receptacle.

In accordance with yet another embodiment of the invention, an electrical connector is provided. The electrical connector includes a carrier containing at least one housing, wherein the housing comprises flexible lances which are maintaining the respective electrical contacts in lock condition in assembled position and in unlock condition in pre-assembled position.

Thus, for some embodiments, the electrical connector enables to make safe contacts for different type of electrical contacts which are inserted into the housing of the electrical connector. Furthermore, the different contacts can be locked into the housing, to assure the electrical connectivity, in the same time by inserting the housing into a carrier.

BRIEF DESCRIPTION OF THE SEVERAL VIEWS OF THE DRAWING

The present invention will now be described, by way of example with reference to the accompanying drawings, in which.

In the different figures, the same reference signs designate like or similar Elements.

DETAILED DESCRIPTION OF THE INVENTION

Figure 1:
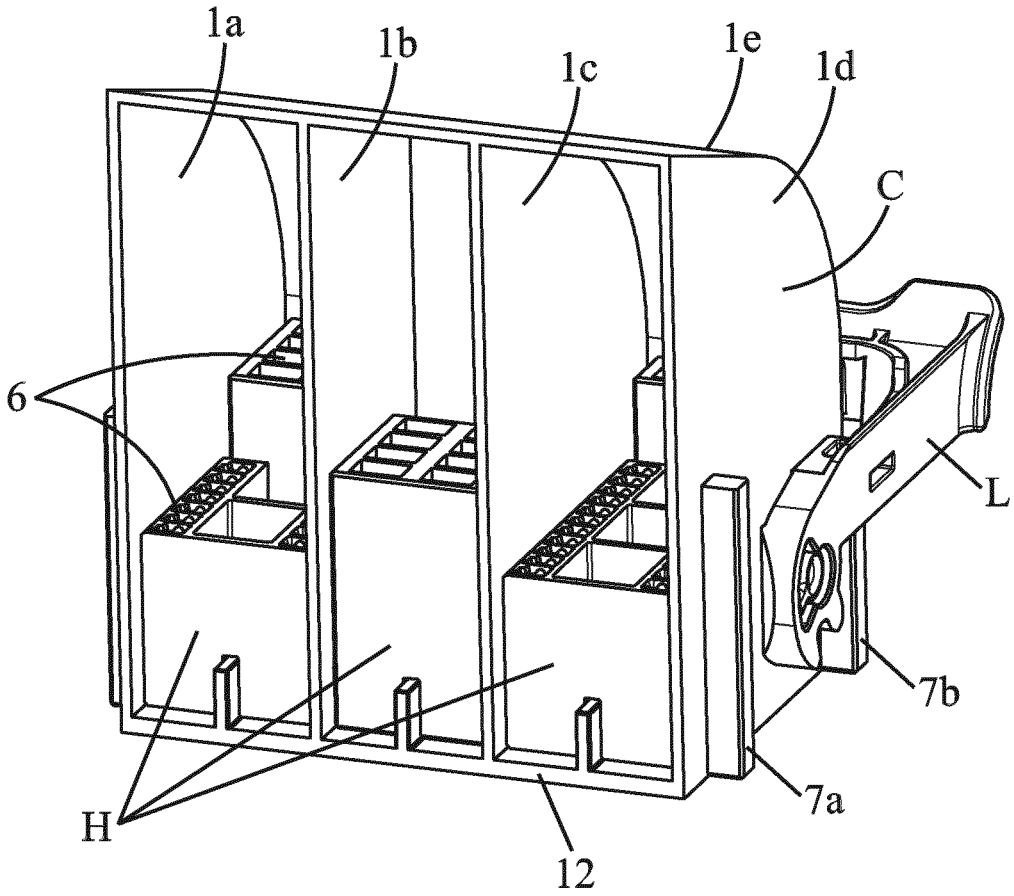
FIG. 1 illustrates a perspective view of a such electrical connector according to a first embodiment comprising a carrier, three housings, a pivotable lever.

The electrical connector comprises a carrier C and a plurality of housings H which, in assembled position are inserted into the internal portion of the housing, more clearly visible on FIG. 1. For the further explanation the base 12 of the carrier will be defined which will be in a mating plane for mating with a counterpart connector, more clearly on seen FIG. 2. Furthermore this plane with its axis will serve as a reference frame, wherein we will define the axis as follows. The normal to this plane will be the axis 7, which will represent the height, and axis X and Y will be inside the plane perpendicular to each other and to the axis Z, so they will form a right-handed coordinate system, as seen on FIG. 2. The direction X is defined as a direction of insertion of a housing in the carrier. The base 12 comprises openings 5, which are cooperating with the receptacles 6 on the housing. The openings 5 and the receptacles are facing each other in assembled position. The interior space of the carder C is divided by vertical walls 1*b*, 1*c* which are separating the housing receiving spaces from each other. The carrier C has a cuboid shape with a rectangular base 12 two flat side walls 1*a*, 1*d*, one curved side wall 1*e* which smoothly joins the top side so copying a shape of a circle. The interval of bending starts from the top and ends before the half of the height of the connector. The opposite side with respect to the curved side is open, thereby enabling the housings H to be introduced in the carrier C.

Figure 3:
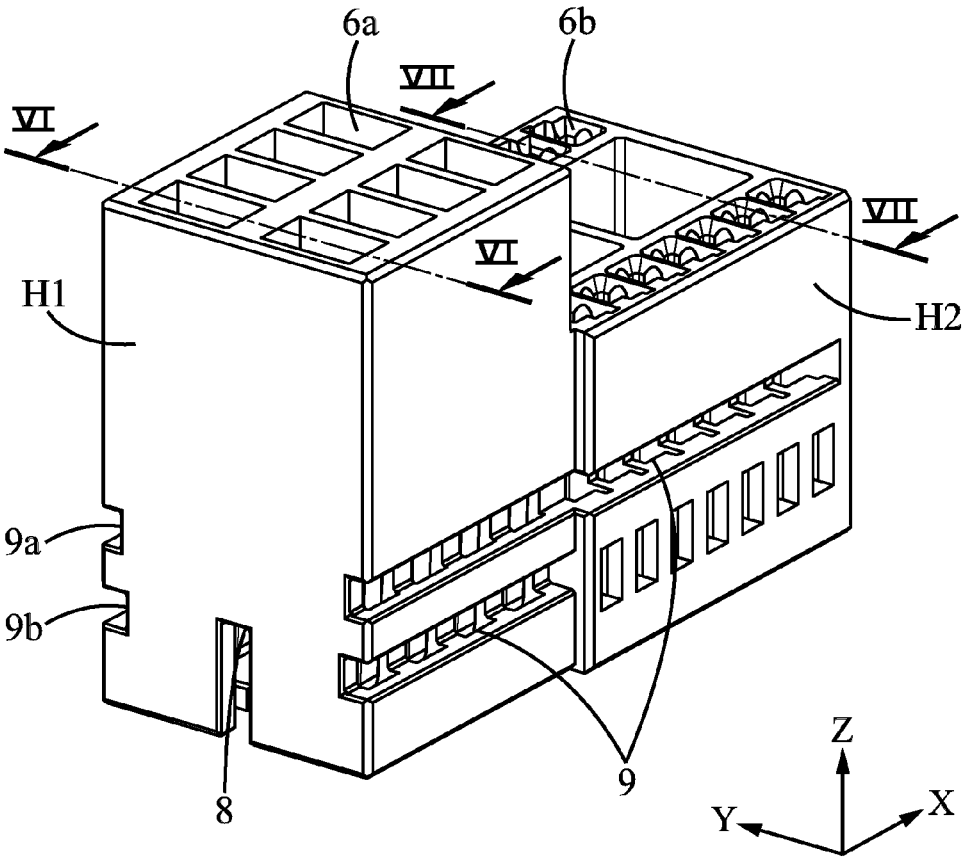
FIGS. 3-5 illustrate a perspective and a top views of the housings.
Figure 4:
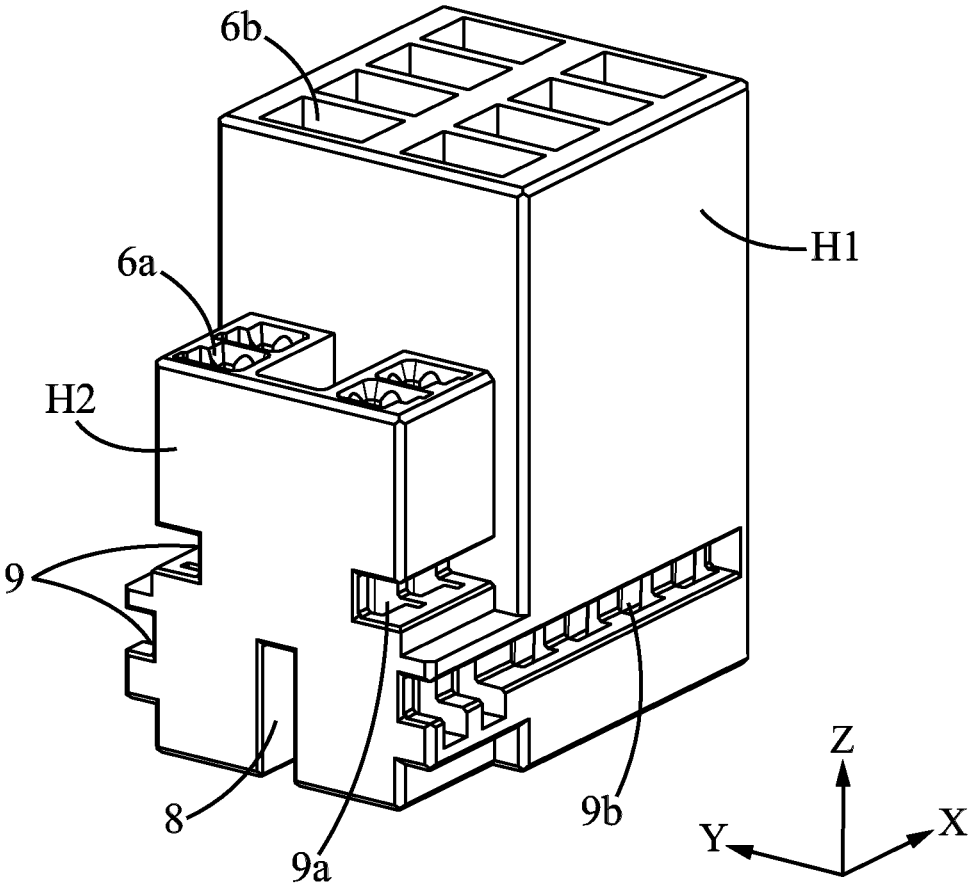
Figure 5:
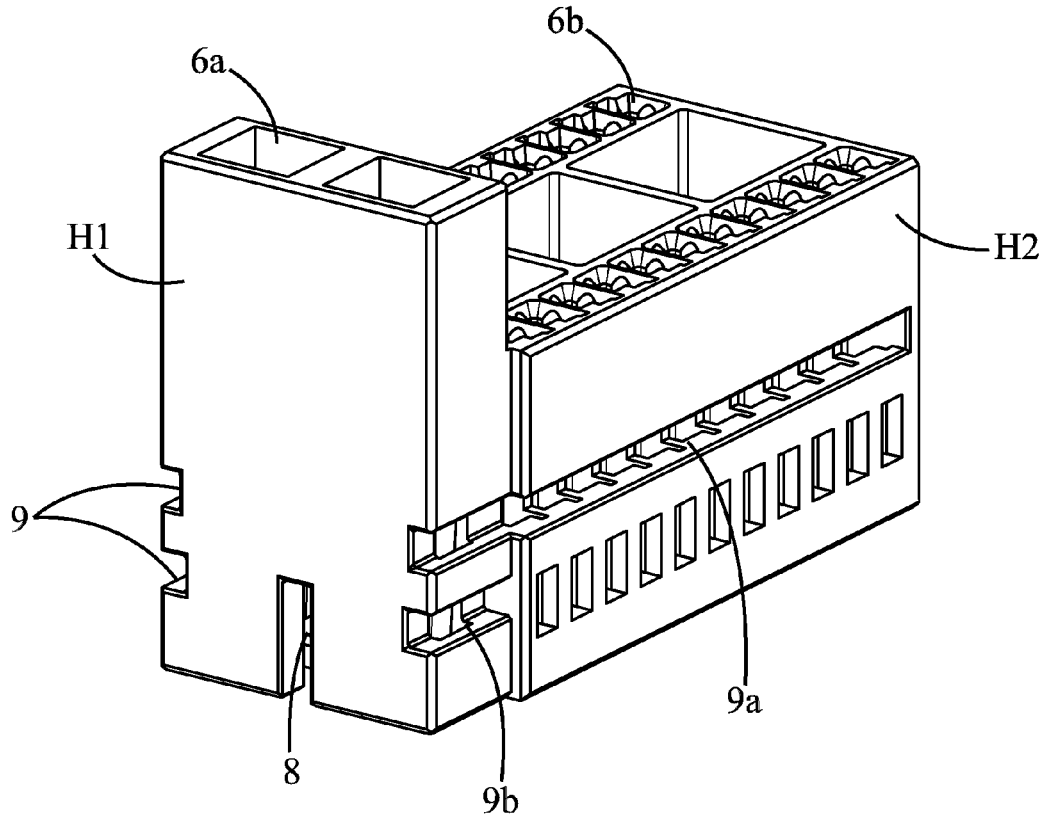

The housings are cuboid shaped and they are able to receive at least two types of respective electrical contacts. The housings are including receptacles 6 able to receive respective electrical contacts. This means that the shape of the housing Ha and Hb is corresponding to the respective electrical contacts. For bigger contacts, the vertical walls of the housings are higher and for the smaller contacts, the walls of the housing are lower, therefore the housing is a junction of a lower Hb and a higher Ha cuboid, as shown on FIGS. 3, 4, and 5. The housing H includes receptacles 6 extending from the top to the bottom sides, with respect to the base of the carrier, with a bottom opening 11 adapted to allow access from the carrier when the openings 5 are facing the bottom opening 11 in assembled position. On the internal sides of the housings, more precisely, the sides which are parallel with the X-Z plane, according to our reference frame previously defined, the housings are incorporating at least one longitudinal groove 9, 9*a*, 9*b*, parallel with axis X. Each vertical wail 1 of the carrier comprises at least one longitudinal protrusion 2 which are in correspondence with a corresponding side groove 9 of the housings H, and in assembled position they are cooperating and complementing the interior space of the carrier C.

Figure 2:
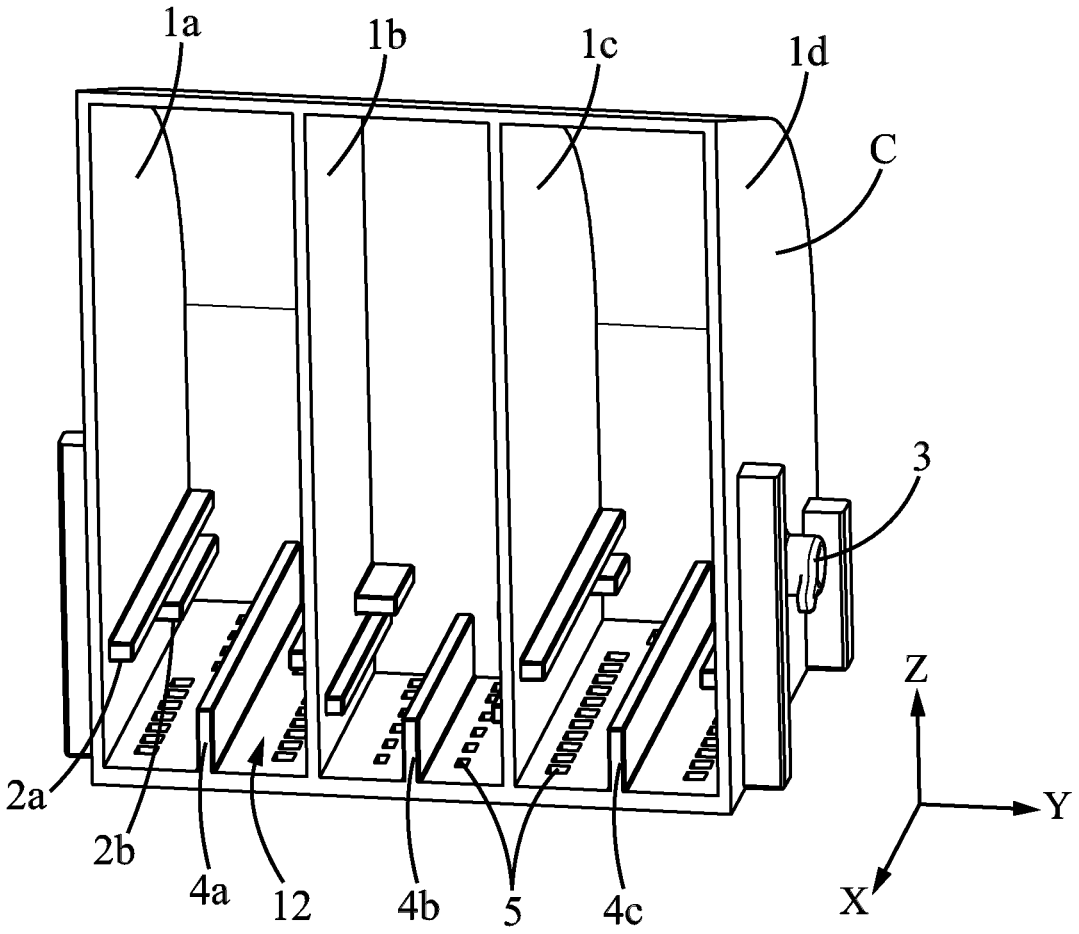
FIG. 2 illustrates a perspective view of the carrier.
Figure 7:
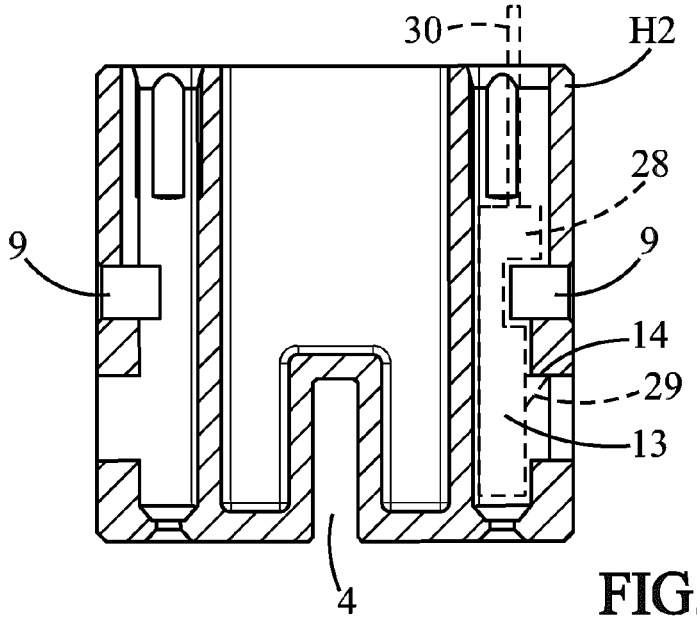
FIG. 7 shows a cross section of the housing without the flexible lance.

The interior space of the carrier is divided by vertical wails I into chambers able to receive housings H. One embodiment of the interior space might be constructed as follows. Each chamber corm rises a longitudinal central rib 4 extending from the base 12, and parallel with the X axis. The housings incorporate a longitudinal central groove 8 parallel with the X axis. The longitudinal central groove 8 of the housings and the longitudinal central rib 4 of the carrier are in correspondence and are cooperating and complementing the interior space of the carrier in assembled position. In assembled position the longitudinal central rib 4 and the longitudinal protrusions 2 of the carrier are cooperating with the correspondent longitudinal central groove 8 and with the longitudinal grooves 9 on the sides of the housing, for maintaining the housing H in the carrier. As can be seen in FIG. 2, each lateral wall 1*a*-1*d* comprises a long protrusion 2*a* and a short protrusion 2*b*. Both extend along the axis X, but with different lengths. Further, both extend from the bottom wall 1*e* of the carrier. The length of the long protrusion is about the whole length from the bottom wall 1*e* to the open wall. The short protrusion is shorter by at least the Width of one receptacle. The short protrusion could be provided either above or below the long protrusions along the axis Z. The height of the long protrusion might be bigger than the height of the short protrusion (distance of the protrusion tip from the lateral wall). The location and sizes of the grooves 9 in the housing match that of the protrusions 2. As can be seen on FIG. 7, which is a cross-section view, a receptacle 13 for a small contact 28 in one of the housings extends from a top end to a bottom end and is shaped to receive a contact. It also has a locking shoulder 14 which is provided to receive the back end of an elastic locking lance 29 of the contact, to lock the contact in the receptacle. For the small contacts, the long protrusion 2*a* interact with the respective groove 9 on the housing H and cooperate directly with the contact. A wire 30 is shown exiting from the receptacle.

Figure 6:
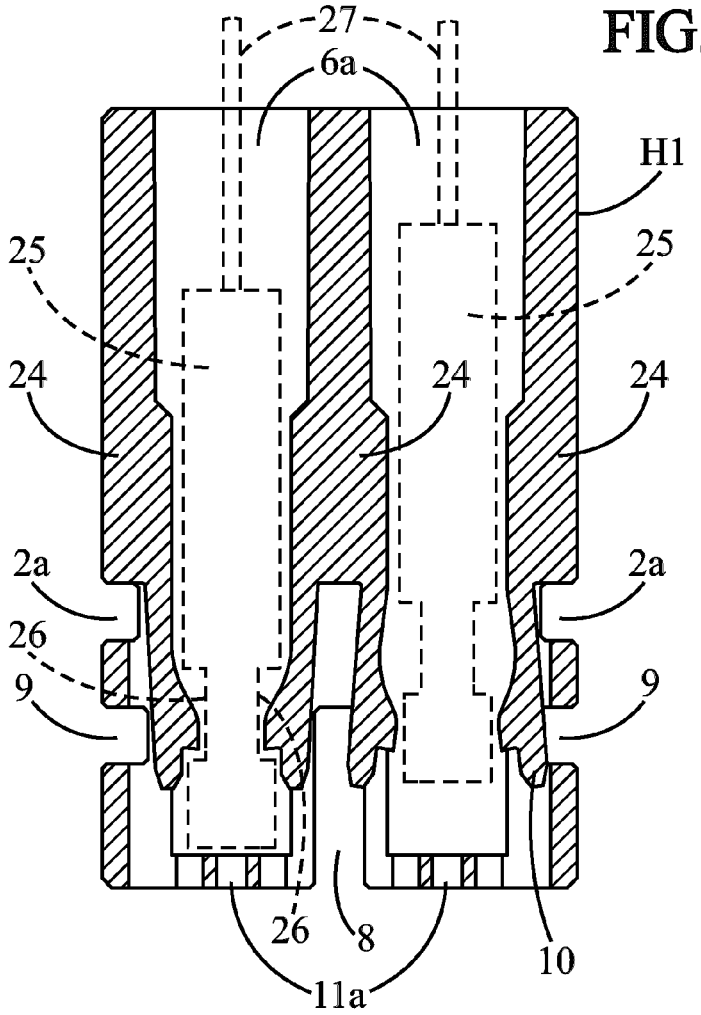
FIG. 6 shows a cross section of the housing.

For the big contacts, as shown on FIG. 6, a flexible locking lance 10 of the housing maintains the respective electrical contact 25 in the housing H. In the present example, two opposed flexible lances 10 extend from a respective base 24 of the housing and are maintaining the big contacts, by cooperation with recesses 26 provided in the contact. Further, they are respectively cooperating with the short protrusion 2*b* and the central rib 4 of the carrier. When the contact is misassembled, and the flexible lance is deflected out of its rest position in its unlock condition, as shown on the right hand side of the FIG. 6, it projects in the groove 9 or 8, respectively. Upon moving the housing with respect to the carrier C from a pre-assembly position toward the assembled position, the deflected lance 10 cooperates with the short protrusion 2*b* or with the central rib 4 to prevent the housing from reaching the assembled position with respect to the carrier C. Thus, the openings 5 and 11 do not face, preventing the complementary contact to enter the receptacle. When the lance 10 is in its lock condition, as shown on the left hand side of FIG. 6, upon moving the housing H with respect to the carrier C from the pre-assembly position toward the assembled position, the lance 10 does not cooperate with the protrusions 2 or the central rib 4, thereby not preventing the housing H from reaching the assembled position. with respect to the carrier C, where the openings 5 and 11 face. Electrical wires 27 are shown exiting from the receptacles.

Depending on the type of housing, at least one side protrusion 2 of the carrier is always cooperating it the correspondent groove 9 of the housing in maintaining the respective electrical contacts in lock condition. The flexible lances 10 of the housing are supported by the protrusions 2 of the side wills of the carrier or with the central longitudinal rib 4 in assembled position and thereby are maintaining firmly the respective electrical contacts in the housing.

Furthermore, turning back to FIGS. 1-2, the side wails 1*a*, 1*d* include a pin 3 which is able to support a pivotable lever L in rotation serving as a fulcrum and to assist the assembly with a mating connector. The pivotable lever comprises an elongated portion, a circular portion and a curved portion. The circular portion incorporates a protuberance and cavities on both sides of the protuberance which is not protruding from the circular shape and can cooperate with a portion of the mating connector which has a correspondent and complementary shape and thereby assists in the assembled position between the two parts.

Figure 10:
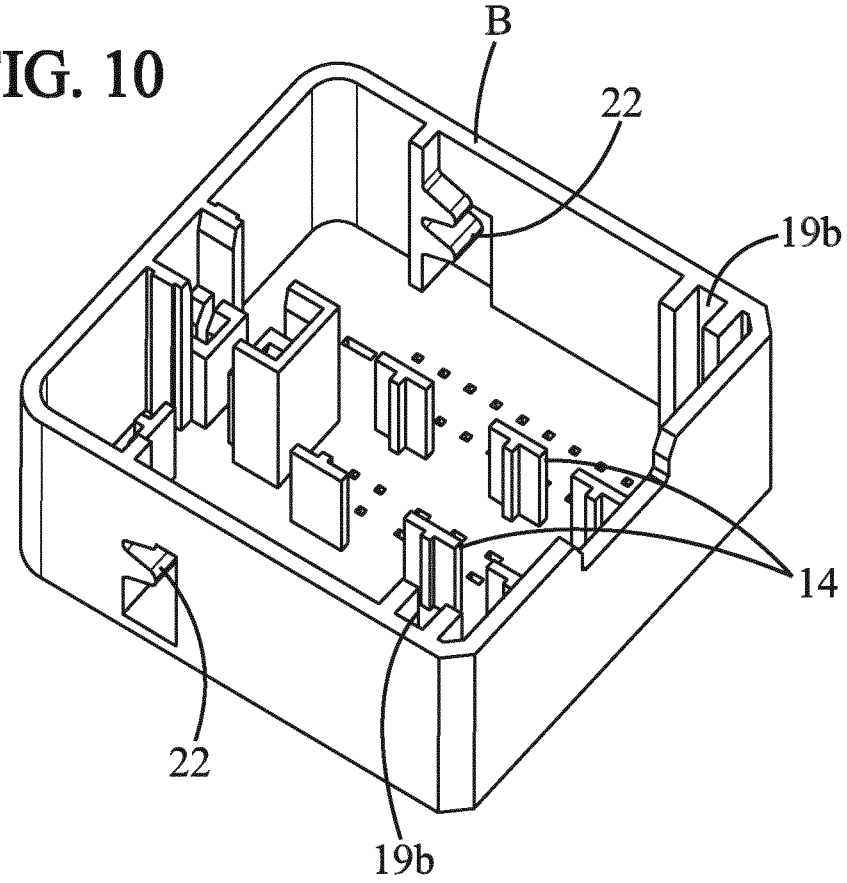
FIG. 10 is a perspective view of complementary connector.
Figure 11:
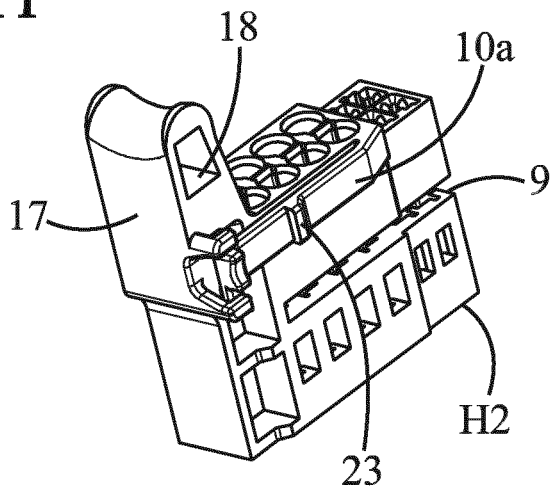
FIG. 11 is a perspective view of a housing for the second embodiment.

Other embodiment of the interior space might be constructed as follows. The electrical connector is made at least of main plastic molded parts being produced separately: carrier C, housings H, which are intended to be inserted into the carrier. The electrical connector is to be connected to a complementary connector B, having electrical contacts E, as seen on FIG. 8. The internal space of the carrier is split by vertical walls 1 in internal portions, wherein first and second housings, H1 and H2, can be inserted. The first housings H1 are provided in the two lateral spaces of the carrier, and are similar to the housings described in relation with the first embodiment. The housing H2 may be independent, and will be described in further details below. It fits in the central space of the carrier. The base of the carrier includes a plurality of openings 5 through which respective electrical contacts can pass into the housings. Moreover, the base 12 of the carrier can include second openings 13 provided to receive the projections 14 of the complementary connector B, more clearly seen on FIGS. 9 and 10. The vertical walls 1 of the carrier C comprise longitudinal protrusions 2, which are parallel with respect to the base of the carrier, in order to cooperate with longitudinal side grooves 9 of the housing. Cooperation of the protrusions 2 with the grooves 9 restricts the movement of the housing H in the internal portion of the carrier C to one direction with respect to the movement from an intermediate position towards an assembled position. The vertical wall 1*c* of the internal portion includes a recess 19 provided to cooperate with a projection of the locking lance 10*a* of the second housing H2 upon an assembled position. Thus as shown on FIG. 11, a locking system of the housing H2 comprises a flexible lance 10*a* having a protruding peg 23 shaped to cooperate with the recess 19 of the carrier.

Figure 12:
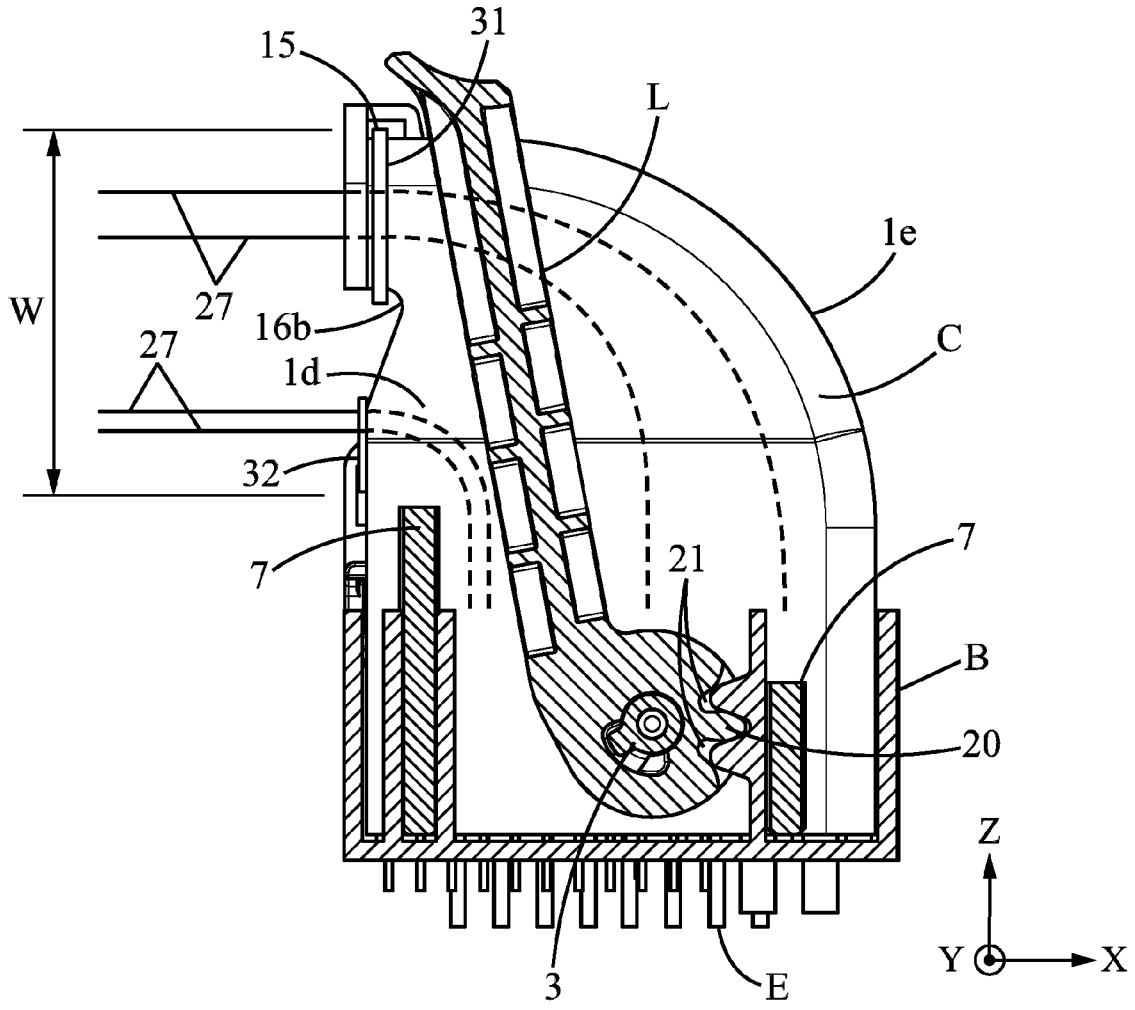
FIG. 12 is a lateral view of the connector assembly of FIG. 8.

The side walls of the carrier comprise ribs 7, which are normal to the base of the carrier. The ribs are adapted to be inserted into complementary grooves 19*b* of the complementary connector and to cooperate in order to assist upon the movement from an intermediate position towards an assembled position between the complementary connector B and the carrier C, as seen on FIG. 10. Furthermore, the side walls 1*a*, 1*d* include a pin 3 which is able to support a pivotable lever L in rotation serving as a fulcrum and to assist the assembly of the complementary connector B and the carrier C. The pivotable lever L comprises an elongated portion, a circular portion and a curved portion, as can be seen on FIG. 12. The circular portion incorporates a protuberance 20 and cavities 21 on both sides of the protuberance 20 which is not protruding from the circular shape and can cooperate with a toothed portion 22 of the bottom portion which has a correspondent and complementary shape and thereby assists in the assembled position between the bottom portion B and the carrier C. The ribs 7 and the pins 3 are provided symmetrically on the opposite mating sides of the carrier. The top side of the carrier includes a hole 15, intended to receive an attachment device such as tightenable rope or link which is provided in order to gather the wires coming from the first housings. The rope is supported with indentations 16*a*, 16*b* in the side walls 1*a*, 1*d*.

Figure 8:
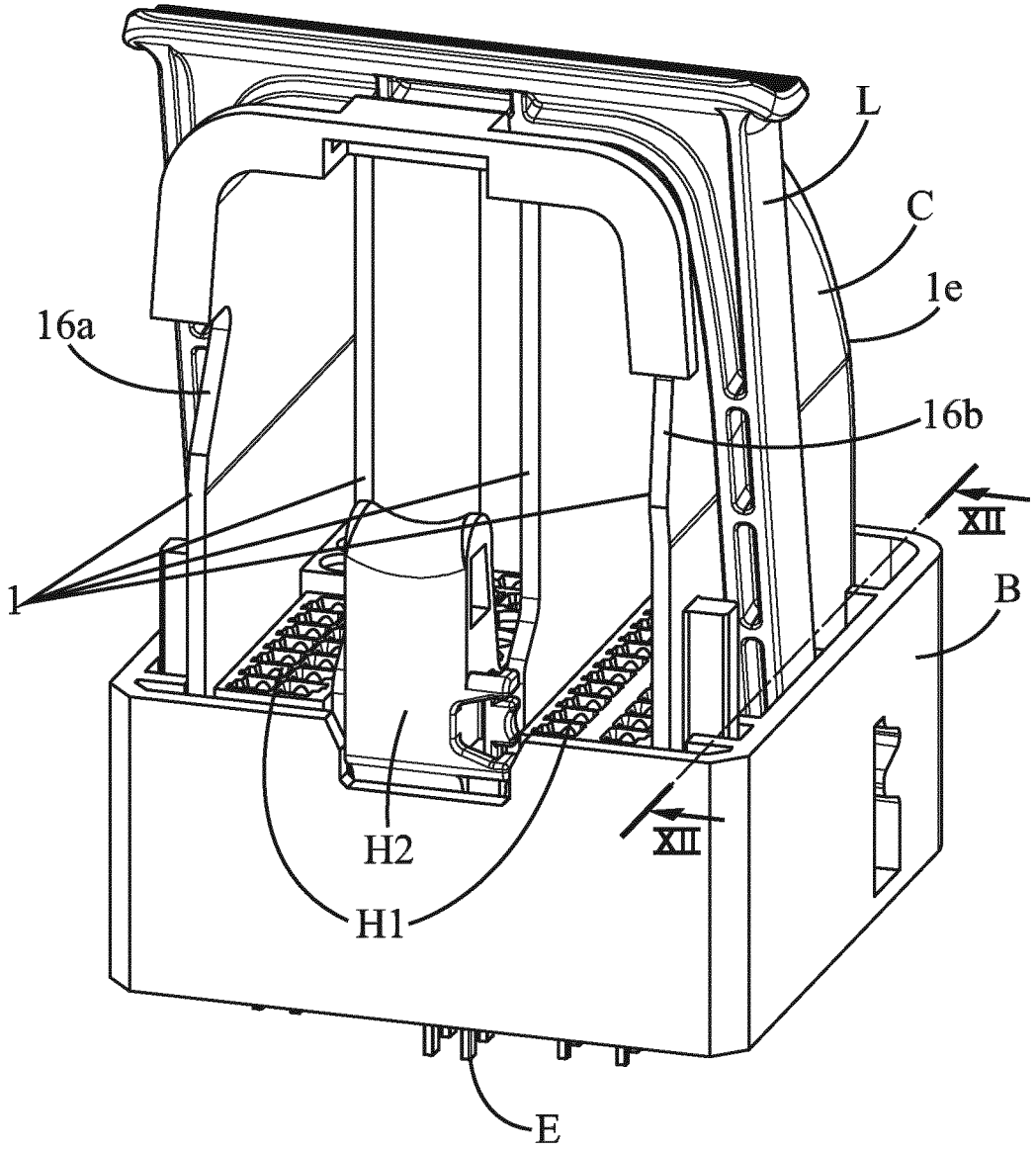
FIG. 8 is a perspective view of a connector assembly for a second embodiment.
Figure 9:
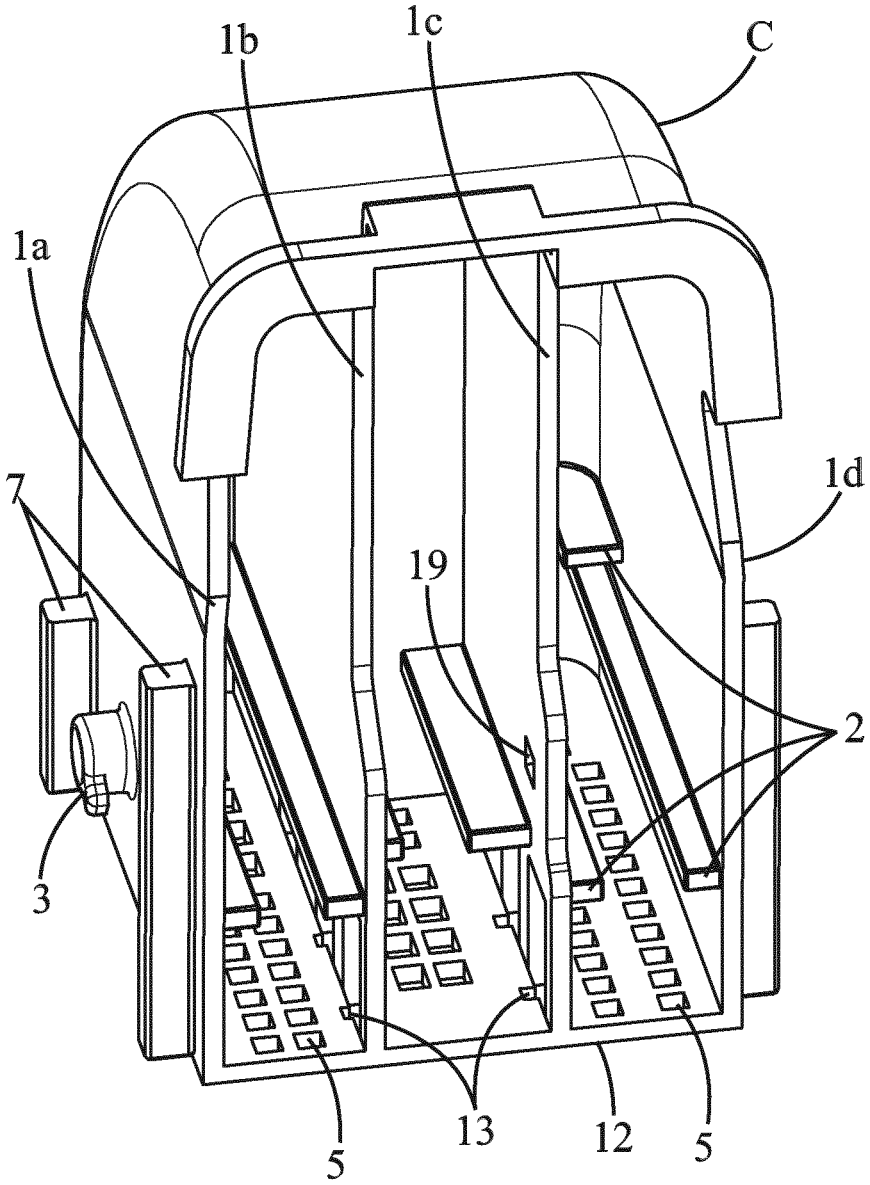
FIG. 9 is a perspective view of the holder for the second embodiment.

According to FIGS. 8 and 9, different housings H can be inserted independently into the internal portion. The electrical wires from the lateral first housings H1 are gathered with using an attachment device 31 as described above. The second housing includes a holding portion 17, more clearly seen on FIG. 11, which serves for holding the electrical wires of the respective electrical contacts. The upper part of the holding portion acts as a guiding portion and is saddle-shaped to receive the electrical wires. The holding portion also incorporates a hole 18 through which an attachment device 32, such as a tightenable rope or link, can pass and thereby is able to tighten the electrical wires to the saddle-shaped upper part of the holding portion.

The system which has just been described in relation to the second embodiment can be operated as follows. Each of the housings H1 is wired, and is assembled into a respective space of the carrier C. The wires extending from these two housings are gathered together, and a suitable attachment device such as a tightenable rope, is placed in the indentations 16*a*, 16*b*, and through the opening 15, to surround all the wires originated from these two housings. Hence, the wires are guided by the inner wall of the curved portion 1*e*, acting as a guiding portion. This connector has an empty slot to receive a supplementary housing.

The housing H2 is wired. The wires are gathered and placed on the saddle shaped upper part of the holding portion 17, and a suitable attachment device, or tightening rope, is passed through the hole 18 and around the wires, so as to neatly attach the wires to the housing H2. Then, the housing H2 is inserted into the central free space (empty slot) in the carrier C. The housing H2 is locked to the carrier C by its locking system, i.e. for example cooperation of the locking peg 23 in the recess 19, or any other suitable way. The window W receives all wires which are attached as two different bundles. Hence, two different harnesses can be used with the same holder.

The number and locations of the housings which are inserted in the carrier are exemplary only.

The connector which has just assembled is placed over a complementary connector B with the ribs 7 in the grooves 19*b* and the protrusions 14 in the openings 13. The lever L is actuated, from its original position as seen on FIG. 1, for example, to its mating position as shown on FIG. 12. Cooperation of the tooth 20 with the toothed portion 22 of the complementary connector B enables to move the carrier C toward the complementary connector B.

The invention claimed is:

1. An electrical connector, comprising:

a housing defining a row of receptacles each configured to receive a respective electrical contact, wherein said housing comprises a base and a flexible lance for a receptacle, said flexible lance configured to flex with respect to the base between a lock condition wherein the flexible lance maintains said electrical contact in the receptacle, and an unlock condition wherein the flexible lance does not maintain said electrical contact in the receptacle; and a carrier configured to receive said housing, wherein said carrier comprises a protrusion, wherein said housing is movable with respect to the carrier between a preassembled position and an assembled position, wherein the flexible lance contacts the protrusion to prevent the housing from reaching the assembled position with respect to the carrier upon moving the housing with respect to the carrier from a preassembled position toward the assembled position when the flexible lance is in the unlock condition, and wherein the flexible lance does not contact the protrusion upon moving the housing with respect to the carrier from the preassembled position toward the assembled position when the flexible lance is in the lock condition, thereby allowing the housing to reach the assembled position with respect to the carrier, and wherein said carrier further comprises an internal portion split by walls wherein the internal portion has a longitudinal rib.

2. The electrical connector according to claim 1, wherein said receptacle has a first opening adapted to allow access in the receptacle, wherein said carder has a second opening associated with said first opening, wherein is an intermediate position, the flexible lance cooperates with the protrusion and said electrical contact is not connectable with a complementary contact of an associated connector and wherein is the assembled position, said electrical contact is connectable with said complementary contact of the associated connector.

3. The electrical connector according to claim 2, wherein said first and second openings are not facing each other in the intermediate position and wherein said first and second openings are facing each other in the assembled position.

4. The electrical connector according to claim 1, wherein said receptacle has a first opening adapted to allow access in the receptacle and said carrier having a second opening associated with said first opening, wherein in an intermediate position-the flexible lance cooperates with the protrusion and said first and second openings are not facing, whereby said electrical contact is not connectable with a complementary contact of an associated connector and wherein in the assembled position, said first and second openings are facing, whereby said electrical contact is connectable with said complementary contact of the associated connector.

5. The electrical connector according to claim 1, wherein the carrier includes a longitudinal central rib provided to cooperate with a longitudinal central groove of said housing in the assembled position.

6. The electrical connector according to claim 5, wherein said lance is a first flexible lance, wherein said receptacle further has a second flexible lance, and said first flexible lance cooperates with the longitudinal central rib and said second flexible lance cooperates with a longitudinal protrusion of the carrier to support said second flexible lance in the lock condition for the electrical contact in the assembled position.

7. An electrical connector comprising:

a housing defining a row of receptacles each configured to receive a respective electrical contact, wherein said housing comprises a base and flexible lance for receptacle, said flexible lance configured to flex with respect to the base between a lock condition wherein the flexible lance maintains said electrical contact in the receptacle, and an unlock condition wherein the flexible lance does not maintain said electrical contact in the receptacle; and a carrier configured to receive said housing wherein said carrier comprises a protrusion, wherein said housing is movable with respect to the carrier between a preassembled position and an assembled position, wherein-the flexible lance contacts the protrusion to prevent the housing from reaching the assembled position with respect to the carrier upon moving the housing with respect to the carrier from a preassembled position toward the assembled position when the flexible lance is in the unlock condition, and wherein the flexible lance does not contact the protrusion upon moving the housing with respect to the carrier from the preassembled position toward the assembled position when the flexible lance is in the lock condition, thereby allowing the housing to reach the assembled position with respect to the carrier, said carrier further comprising a pin configured to support a pivotable lever in rotation serving as a fulcrum for said pivotable lever.

8. The electrical connector according to claim 7, further comprising the pivotable lever comprising an elongated portion, a circular portion and a curved portion.

9. The electrical connector according to claim 7, wherein said pivotable lever contains a circular portion and wherein said circular portion incorporates a protuberance and cavities on both sides of the protuberance which are not protruding from the circular portion.

10. The electrical connector according to claim 7, wherein said receptacle has a first opening adapted to allow access in the receptacle, wherein said carrier has a second opening associated with said first opening, wherein is an intermediate position, the flexible lance cooperates with the protrusion and said electrical contact is not connectable with a complementary contact of an associated connector and wherein is the assembled position, said electrical contact is connectable with said complementary contact of the associated connector.

11. The electrical connector according to claim 10, wherein said first and second openings are not facing each other in the intermediate position and wherein said first and second openings are facing each other in the assembled position.

12. The electrical connector according to claim 7, wherein said receptacle has a first opening adapted to allow access in the receptacle and said carrier having a second opening associated with said first opening, wherein in an intermediate position-the flexible lance cooperates with the protrusion and said first and second openings are not facing, whereby said electrical contact is not connectable with a complementary contact of an associated connector and wherein in the assembled position, said first and second openings are facing, whereby said electrical contact is connectable with said complementary contact of the associated connector.

13. The electrical connector according to claim 7, wherein the carrier includes a longitudinal central rib provided to cooperate with a longitudinal central groove of said housing in the assembled position.

14. The electrical connector according to claim 13, wherein said lance is a first flexible lance, wherein said receptacle further has a second flexible lance, and said first flexible lance cooperates with the longitudinal central rib and said second flexible lance cooperates with a longitudinal protrusion of the carrier to support said second flexible lance in the lock condition for the electrical contact in the assembled position.

* * * * *